343-700 MS AJ 251 EX
8/11/87 OR 4,686,536

United States Patent [19]

Allcock

[11] Patent Number: 4,686,536

[45] Date of Patent: Aug. 11, 1987

[54] CROSSED-DROOPING DIPOLE ANTENNA

[75] Inventor: David Allcock, Carp, Canada

[73] Assignee: Canadian Marconi Company, Canada

[21] Appl. No.: 765,834

[22] Filed: Aug. 15, 1985

[51] Int. Cl.[4] ..... H01Q 1/38

[52] U.S. Cl. ..... 343/700 MS; 343/795; 343/797; 343/798

[58] Field of Search ..... 343/700 MS, 797, 798, 343/795

[56] References Cited

U.S. PATENT DOCUMENTS

| | | | |
|---|---|---|---|
| 2,480,153 | 8/1949 | Masters | 343/795 |
| 2,480,154 | 8/1949 | Masters | 343/795 |
| 2,973,517 | 2/1961 | Watts, Jr. | 343/795 |
| 3,025,524 | 3/1962 | Thies | 343/795 |
| 3,039,095 | 6/1962 | Josephson | 343/830 |
| 3,114,913 | 12/1963 | Alford | 343/795 |
| 3,369,245 | 2/1968 | Rea | 343/795 |
| 3,815,141 | 6/1974 | Kigler | 343/795 |
| 3,836,976 | 9/1974 | Monser et al. | 343/797 |
| 4,084,162 | 4/1978 | Dubost et al. | 343/700 MS |
| 4,287,518 | 9/1981 | Ellis, Jr. | 343/700 MS |
| 4,426,649 | 1/1984 | Dubost et al. | 343/700 MS |

FOREIGN PATENT DOCUMENTS

| | | | |
|---|---|---|---|
| 0062902 | 4/1983 | Japan | 343/700 MS |

*Primary Examiner*—Robert E. Wise
*Assistant Examiner*—D. Johnson
*Attorney, Agent, or Firm*—Fishman & Dionne

[57] ABSTRACT

A first planar printed circuit board and a second planar printed circuit board are assembled to intersect each other at right angles to each other. Each board includes a microstrip realization of a drooping dipole antenna. The realization comprises, for each planar board, two vertical parallel feed lines with a radiating element extending from each feed line. Each of the feed lines is fed 90° out of phase with the other feed line on the same board.

6 Claims, 5 Drawing Figures

FIG. 1
(PRIOR ART)
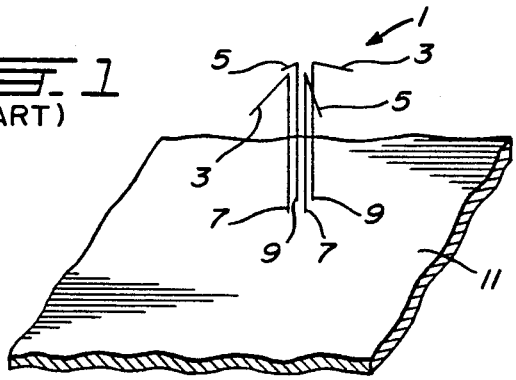
FIG. 2
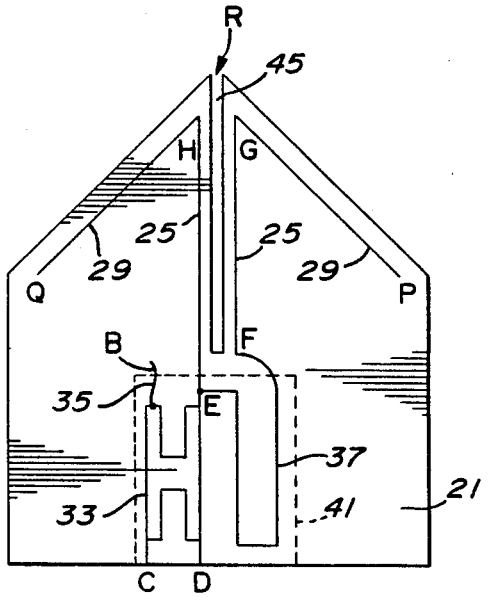
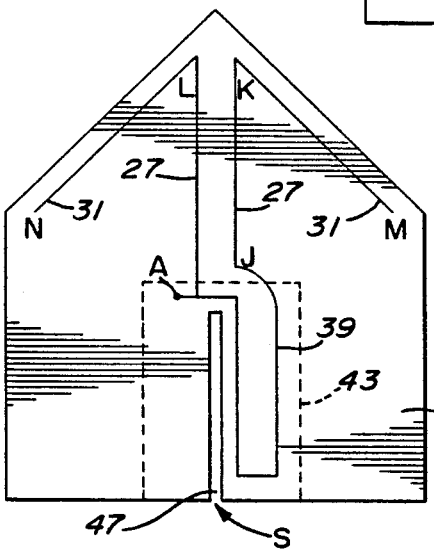
FIG. 3

CROSSED-DROOPING DIPOLE ANTENNA

BACKGROUND OF THE INVENTION

Field of the Invention

The invention relates to a crossed-drooping dipole antenna arrangement. More specifically, the invention relates to a microstrip realization of such an arrangement.

DEFINITION

A microstip antenna is defined, as per MICROSTRIP ANTENNAS, Authors I. J. Bahl and P. Bhartia, publisher Artech House, at page 2, as ". . . a microstrip antenna in its simplest configuration consists of a radiating patch on one side of a dielectric substrate . . . which has a ground plane on the other side."

A dipole antenna is an antenna having two radiating elements in alignment with each other and fed with a balanced feed. A crossed dipole antenna consists of two dipoles at right angles to each other. A crossed-drooping dipole is the same as a crossed dipole but with the radiating elements extending downwardly at an acute angle to the balanced feed.

Finally, a microstrip orossed-drooping dipole antenna is an antenna having the characteristics of a microstrip antenna as above defined as well as the characteristics of a crossed-drooping dipole antenna.

DESCRIPTION OF PRIOR ART

Crossed-drooping dipole arrangements disposed above a ground plane are well known means for producing nominally circular polarized reception or transmission radiation patterns at fre9uencies from VHF to microwave wavelengths. It is usually realized in a coaxial configuration involving separate subassemblies for achieving the "balun" (unbalanced to balanced), matching and arm phasing functions.

Microstrip as an R.F. transmission medium and as means for constructing certain components and antennas is also known in the art. For example, U.S. Pat. No. 3,836,976, Sept. 17, 1974, Monser et al, teaches a spaced or diagonal notch array using microstrip on printed circuit boards.

However, no attempt has been made to realize a nominally circularly polarized crossed-drooping dipole antenna arrangement which includes the balun and the matching and arm phasing functions directly on two intersecting circuit boards which also include the feed lines and the radiating elements.

SUMMARY OF THE INVENTION

It is therefore an object of the invention to provide a microstrip realization of a crossed-drooping dipole antenna arrangement.

In accordance with the invention, a microstrip crossed-drooping dipole antenna arrangement comprises a first planar printed circuit board and a second planar printed circuit board, the circuit boards being assembled to intersect each other at right angles to each other. Each board has a microstrip realization of a drooping dipole antenna which realization includes, for each planar board, first vertical feed line and a side-by-side second vertical feed line. A first radiating element extends from the first feed line on the side of the first feed line opposite the second feed line and drooping from the first feed line and a second similar radiating element extends from the second feed line. Means are provided for feeding the feed lines of the first and second board such that they have a nominal 90° phase relationship with each other.

BRIEF DESCRIPTION OF THE DRAWINGS

The invention will be better understood by an examination of the following description, together with the accompanying drawings, in which:

FIG. 1 illustrates a prior art crossed-drooping dipole antenna arrangement;

FIG. 2 illustrates one printed circuit board for constructing a microstrip realization of a crossed-drooping dipole antenna arrangement;

FIG. 3 illustrates the second printed circuit board of the arrangement;

DESCRIPTION OF PREFERRED EMBODIMENTS

Figure 4:
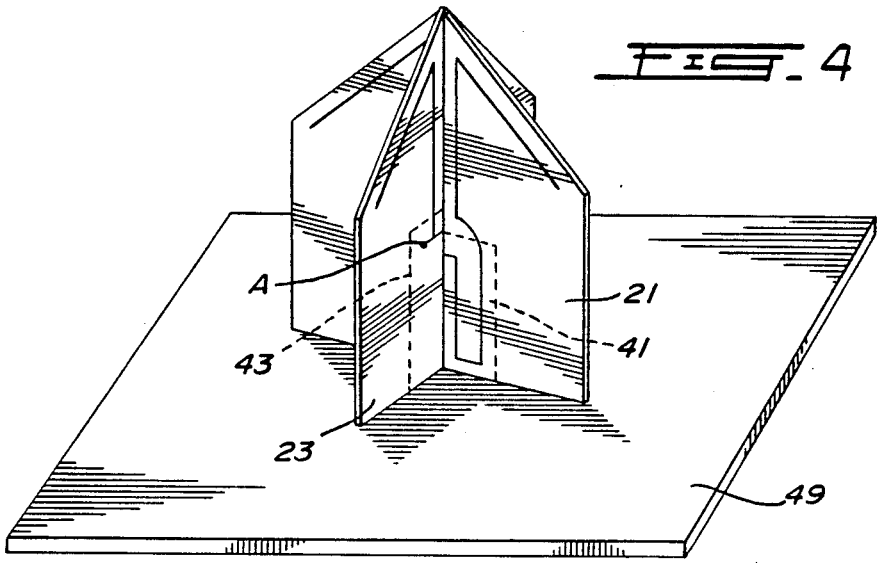
FIG. 4 illustrates an assembly of the circuit boards in FIGS. 2 and 3.

Referring to FIG. 1, a typical crossed-drooping dipole antenna arrangement, illustrated generally at 1, comprises a first pair of radiating elements 3 which are coplanar, and a second pair of radiating elements 5, which are also coplanar, and which are disposed at right angles to the first pair of radiating elements. Feed lines 7 are connected to radiating elements 3 and feed lines g are connected to radiating elements 5. The arrangement is mounted on a ground plane 11.

Such arrays are normally fed from coaxial, that is, unbalanced lines so that a balun is required between the coaxial line and the feed lines 7 and 9. In addition, the input to 7 must be at 90° phase relationship with the input to 9. Accordingly, a phase shifting coupler must also be provided. The balun and the coupler are normally included as a separate subassembly.

Turning now to FIGS. 2 and 3, there are illustrated a first printed circuit board 21 and a second printed circuit board 23. Side-by-side vertical feed lines 25, which are preferably parallel to each other, are conductors printed onto the circuit board 21, and feed lines 27 are conductors printed onto the printed circuit board 23. As can be seen, feed lines 27 are also side-by-side and preferably parallel to each other. Extending from each feed line 25, on the side of each feed line opposite to the other feed line, is a radiating element 29 which preferably droops towards its respective feed line 25. The radiating elements are also conductors which are printed onto the printed circuit board 21. Similar radiating element conductors 31 are printed onto the circuit board 23. Circuit board 21 also includes a coupler having two inputs C and D and two outputs B and E. The output at B is phase shifted 90° lagging or leading the output at E depending on which input is used. As is known, the sense of circular polarization is determined by whether the output at B leads or lags the output at E. Accordingly, by providing two inputs, it is possible to provide circular polarization in either direction. If only one polarization is needed, the other terminal is preferably resistively terminated. Other means for providing the nominal 90° phase shift and power division may also be realized, using microstrip components and/or lumped elements.

Output E is connected to feed lines 25, and output B is connected, by conductive means 35, to feed lines 27 via point A on printed circuit board 23.

A balun 37 is disposed between the output E and the feed lines 25 on printed circuit board 21. The balun is a half wavelength of microstrip printed onto the circuit board. The shape of the balun is not significant. It is merely necessary that the microstrip which forms the shape should extend for a full half wavelength at the fre9uency of operation. Similarly, balun 39 is a half wavelength of microstrip printed onto the printed circuit board 23. Groundplane 41 is a conductive pattern in the lower center portion of the reverse side of printed circuit board 21, (as shown in dotted lines in FIG. 3), and groundplane 43 is a conductive pattern on the reverse side of printed circuit board 23 (as shown in dotted lines in FIG. 4).

A slot 45 extends downwardly from the top of printed circuit board 21 in the center thereof, and slot 47 extends upwardly from the bottom of printed circuit board 23 and centrally of the circuit board. To assemble an arrangement, slot 47 is slid downwardly along slot 45 until slot 47 overlaps the lower part of printed circuit board 21, and slot 45 overlaps the top part of printed circuit board 23. As seen in FIG. 4, the printed circuit boards intersect each other at right angles to each other.

at right angles to each other.

As can also be seen best in FIG. 4, both the circuit boards are planar circuit boards.

The entire arrangement is mounted on a ground plane 49. The dimensions of the antenna arrangement may be adjusted to yield, within limits, desired radiation pattern characteristics. Such dimensions include the angle between the feed line and its respective radiating element, and the height of the structure above the ground plane, which contributes the overall behaviour of the antenna arrangement. It is also possible to use radiating arms other than straight drooping configurations.

The printed circuit boards are, preferably, dielectric sheets. The portions 25, 27, 29, 31, 33, 35, 37 and 39 are printed on the dielectric in the normal printed circuit art.

The two hybrid outputs E and B, in addition to having a nominal 90° phase relationship with each other, are of nominally e9ual power as determined by the relative characteristic impedances, (i.e. line widths) of the lines forming the hybrid. It is of course realized that other realizations (shapes) of both the power splitter 33 and the baluns 37 and 39 can be used. In addition to other microstrip line shapes, lumped components could be used for this purpose.

The lines EH and FG (feed lines 25) form a balanced transmission feed line with impedance dependent upon the spacing between these lines which may be adjusted for correct matching. The lines AL and JK have the same properties.

Radiating arms HQ, GP, LN and KM are extensions of the feed lines. They may be of a straight, drooping configuration as illustrated in the drawings, or composed of straight or curved sections, to suit the particular radiating patterns needed.

The connection to the antenna may be by means of a co-axial to microstrip launcher connected to terminals C or D or both from the underside of the ground plane 49. The assembled antenna arrangement may be connected to the ground plane 49 by means of a convenient conductive connection between the ground planes 41 and 43 of printed circuit boards 21 and 22 respectively. The ground plane (outer) connection for the co-axial connector may then conveniently be made via the underside of ground plane 49. Alternatively, a connection from C or D (or both) may be made to a microstrip line on the surface ground plane 49, or the underside of ground plane 49. As a further modification, a phase shifter may be included as part of the antenna, either in lumpedelement or microstrip form.

Figure 5:
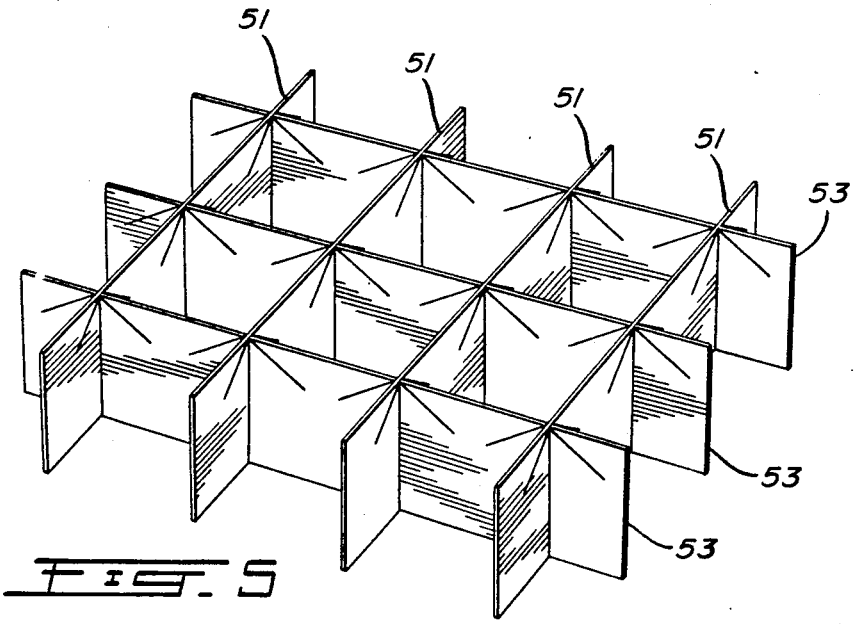
FIG. 5 illustrates an integrated array of a plurality of arrangements as described in FIGS. 2 to 4 above.

It is also possible, in accordance with the invention, to construct a multi-antenna array as illustrated in FIG. 5. As can be seen in FIG. 5, there are provided a multiplicity of printed circuit boards 51 which are arranged to be parallel to each other. A plurality of further boards 53, which are also parallel to each other, are arranged to intersect the boards 51. An antenna arrangement is defined at each of the intersections by microstrip printing of the type illustrated in FIGS. 3 and 4. An array of this type is advantageous for creating a linear or planar phased array of elements for scanning a narrow beam over a wide volumetric coverage.

Although several embodiments have been described, this was for the purpose of illustrating, but not limiting, the invention. Various modifications, which will come readily to the mind of one skilled in the art, are within the scope of the invention as defined in the appended claims.

I claim:

1. A microstrip crossed-drooping dipole antenna arrangement, comprising:

a first planar printed circuit board and a second planar printed circuit board, said boards being assembled to intersect each other at right anles to each other;

each said board comprising a microstrip realization of a drooping dipole antenna;

said realization comprising, for each planar board and on one side of said board, a first vertical feed line and a second side-by-side vertical feed line; a first radiating element extending from said first feed line on the side of said first feed line opposite said second feed line and a second radiating element extending from said second feed line on the side of said second feed line opposite said first feed line;

a ground plane on each said board comprising a conductive pattern formed on the other side of said board; and means for feeding said feed lines of said first and second boards such that they have a nominal 90° phase relationship with each other.

2. An arrangement as defined in claim 1 wherein said means for feeding comprises a coupler means having an input, a first output and a second output, wherein a signal appearing at said second output has a 90° phase relationship with a signal appearing at said first output.

3. An arrangement as defined in claim 2 wherein said coupler means comprises a two-branch hybrid coupler mounted on said first board, said first output being connected to the feed lines on said first board and said second output being connected to the feed lines on said second board.

4. An arrangement as defined in claim 3 and further comprising, on said first board, a first balun means connected between said first output and said feed lines of said first board, and a second balun means connected between said second output and said feed lines on said second board;

each said balun means being one-half wave length long.

5. An arrangement as defined in claim 4 wherein said first board has a slot extending from the top of said board downwardly, and wherein said second board has a slot extending from the bottom of said second board upwardly; and wherein, when said boards are assembled, said slot on said second board overlaps with the bottom portion of said first board and said slot on said first board overlaps with the top portion of said second board.

6. A multi-microstrip crossed-drooping dipole antenna array, comprising a plurality of arrangements as defined in claim 1, comprising:

a first plurality of printed circuit boards disposed parallel to each other;

a second plurality of boards intersecting said first plurality of boards at right angles, said second plurality being parallel to each other;

wherein a separate arrangement is defined at each intersection.

* * * * *